US007020426B2

(12) United States Patent
Takagi et al.

(10) Patent No.: US 7,020,426 B2
(45) **Date of Patent: *Mar. 28, 2006**

(54) FIXING APPARATUS AND IMAGE FORMING APPARATUS

(75) Inventors: Osamu Takagi, Tokyo (JP); Satoshi Kinouchi, Tokyo (JP); Yoshinori Tsueda, Fuji (JP); Toshihiro Sone, Fujieda (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/067,747

(22) Filed: Mar. 1, 2005

(65) Prior Publication Data

US 2005/0147437 A1 Jul. 7, 2005

Related U.S. Application Data

(63) Continuation of application No. 10/390,645, filed on Mar. 19, 2003, now Pat. No. 6,871,041.

(51) Int. Cl.
*G03G 15/20* (2006.01)

(52) U.S. Cl. ..... 399/330; 399/335

(58) Field of Classification Search ..... 399/92, 399/320, 328, 330, 333, 334, 335, 336
See application file for complete search history.

(56) References Cited

U.S. PATENT DOCUMENTS

| | | | | |
|---|---|---|---|---|
| 5,713,069 | A | 1/1998 | Kato | |
| 5,822,669 | A | 10/1998 | Okabayashi et al. | |
| 6,026,273 | A | 2/2000 | Kinouchi et al. | |
| 6,037,576 | A | 3/2000 | Okabayashi et al. | |
| 6,078,781 | A | 6/2000 | Takagi et al. | |
| 6,087,641 | A | 7/2000 | Kinouchi et al. | |
| 6,292,648 | B1 | 9/2001 | Higaya et al. | |
| 6,337,969 | B1 | 1/2002 | Takagi et al. | |
| 6,377,775 | B1 | 4/2002 | Nakayama et al. | |
| 6,438,335 | B1 | 8/2002 | Kinouchi et al. | |
| 6,445,902 | B1 | 9/2002 | Hirst et al. | |
| 6,625,417 | B1 | 9/2003 | Terada et al. | |
| 6,643,476 | B1 | 11/2003 | Kinouchi et al. | |
| 6,643,491 | B1 | 11/2003 | Kinouchi et al. | |
| 6,687,482 | B1 | 2/2004 | Maeda et al. | |
| 6,724,999 | B1 | 4/2004 | Kikuchi et al. | |
| 6,725,000 | B1 | 4/2004 | Takagi et al. | |
| 6,763,206 | B1 | 7/2004 | Kinouchi et al. | |
| 6,871,041 | B1 * | 3/2005 | Takagi et al. | 399/330 |
| 2004/0173603 | A1 | 9/2004 | Kinouchi et al. | |
| 2004/0175211 | A1 | 9/2004 | Sone et al. | |
| 2004/0175212 | A1 | 9/2004 | Tsueda et al. | |
| 2004/0179874 | A1 | 9/2004 | Kinouchi et al. | |

FOREIGN PATENT DOCUMENTS

| | | | |
|---|---|---|---|
| JP | 8-129313 | A | 5/1996 |
| JP | 2001-005315 | A | 1/2001 |
| JP | 2001-235964 | A | 8/2001 |

* cited by examiner

*Primary Examiner*—Sandra L. Brase
(74) *Attorney, Agent, or Firm*—Foley & Lardner LLP

(57) ABSTRACT

A heat roller is configured to have a heat insulating member 4 and a metal member formed on the heat insulating member. Coils 21, 22 and 23 are provided outside the heating roller 2 to induction-heat the heating roller 2.

16 Claims, 11 Drawing Sheets

FIXING APPARATUS AND IMAGE FORMING APPARATUS

The present application is a continuation of U.S. application Ser. No. 10/390,645, filed Mar. 19, 2003 now U.S. Pat. No. 6,871,041, the entire contents of which are incorporated herein by reference.

BACKGROUND OF THE INVENTION

An image forming apparatus scans a document image, forms a developing agent image corresponding to the scanned image on a sheet and fixes the resultant image to the sheet by a fixing apparatus.

The fixing apparatus has a heating roller and pressing roller, and a developing agent image bearing sheet is passed between the heating roller and the pressing roller to fix the developing agent image to the sheet to the sheet. A tungsten halogen lamp, for example, is held inside the heating roller. The temperature of the heating roller is raised by the heat generated by the halogen lamp heater, and the developing agent on the sheet is melted under the heating of the heating roller.

In an induction heating type fixing apparatus, a coil for induction heating is held inside the heating roller and, by supplying high frequency current to the coil, a high frequency magnetic field is generated from the coil. Under the high frequency magnetic field, an eddy current is generated from the coil and, due to the Joule heat generated by the eddy current, heat generation occurs in the heating roller.

A heating roller for holding a halogen lamp heater or an induction heating coil is greater in its heat capacity. For such a heating roller of a greater heat capacity, a longer time is taken from after a start operation until the heating roller reaches a temperature necessary for a fixing process.

BRIEF SUMMARY OF THE INVENTION

It is accordingly the object of the present invention to provide a fixing apparatus and image forming apparatus which can lower a heat capacity of a heating roller and hasten a temperature rise of the heating roller after a start operation has been performed.

In an aspect of the present invention, there is provided a fixing apparatus comprising a heating roller having a heat insulating layer, and a metal layer formed on the heat insulating layer, a coil being provided outside the heating roller and configured to generate a high frequency magnetic field for induction-heating the heating roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

[1] With reference to the accompanying drawings, an explanation will be made below about a first embodiment of the present invention.

An image forming apparatus according to the present invention comprises a scanning unit (later-described scanning unit 33) for optically reading out a document image, a process unit (later-described process unit 45) for allowing a developing agent image which corresponds to the read-out document image to be formed on an image formation sheet, a fixing apparatus (later-described fixing apparatus 1) for allowing the developing agent image which is formed on the sheet to be fixed to the sheet under heating, and so on. The detailed arrangement of the image forming apparatus is described in earlier application Ser. No. 09/955,089. The explanation of its structure is omitted here.

Figure 1:
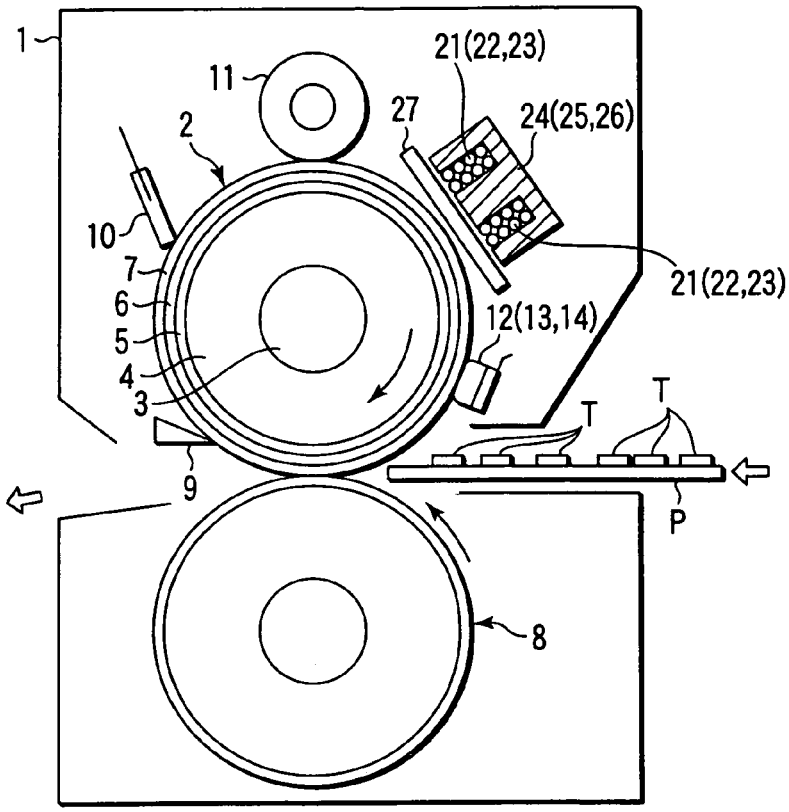
FIG. 1 is a view showing a structure of a fixing apparatus according to a first embodiment of the present invention.
Figure 2:
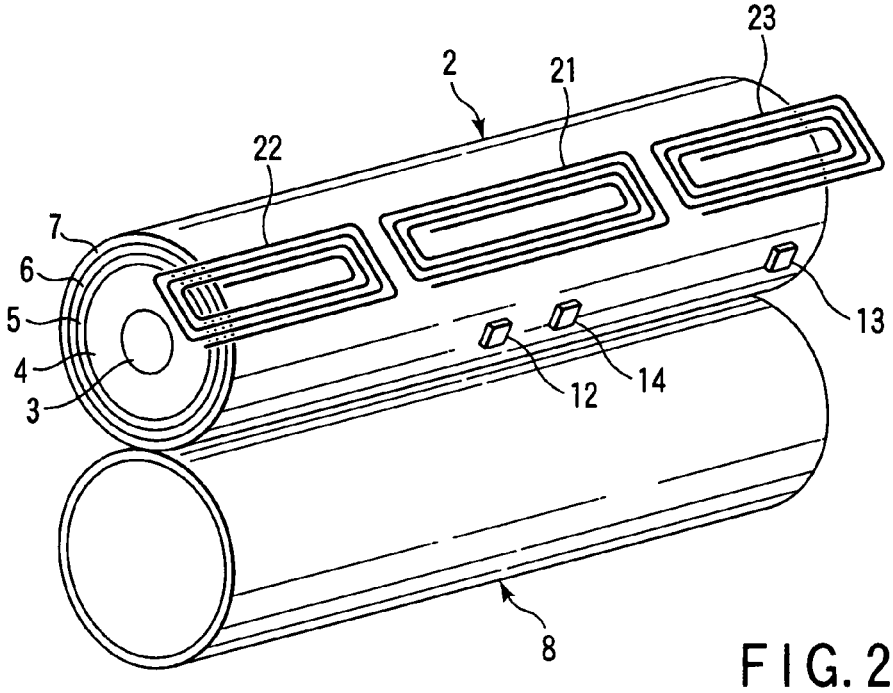
FIG. 2 is a view showing a structure of a heating roller and respective coils in the first embodiment of the present invention.
Figure 3:
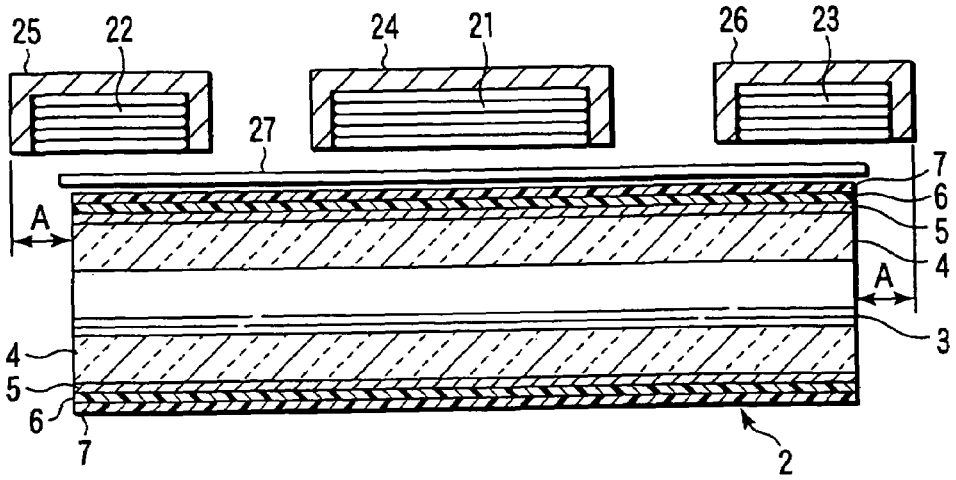
FIG. 3 is a view showing a heating roller, respective coils and respective cores in the first embodiment.

The structure of the fixing apparatus above is shown in FIGS. 1, 2 and 3.

The fixing apparatus 1 has a heating roller 2. The heating roller 2 and pressing roller 8 are so arranged as to allow a sheet passing path to be formed between the heating roller 2 and the pressing roller 8. The pressing roller 8 is pressed, by a pressure applying mechanism not shown, against a surface (outer peripheral surface) of the heating roller 2. A given nip width is provided at a contacting site between the heating roller 2 and the pressing roller 8.

The heating roller 2 is so configured as to have a heat insulating member 4 of, for example, 5 mm thick, a metal member 5 of, for example, 40 μm thick, an elastic member 6 of, for example, 0.3 mm thick, and a surface member 7 of, for example, 20 μm, formed in that order on a core metal 3. The heating roller 2 is rotationally driven in a clockwise (as indicated) direction. The heat insulating member 4, if being over 0.5 mm thick, exhibits an adequate heat insulating property.

The pressing roller 8 is rotated in a counter-clockwise (as indicated) direction upon receipt of a rotation force of the heating roller 2. The sheet P is conveyed between the heating roller 2 and the pressing roller 8 in an up/down sandwiched fashion and, by transmitting heat of the heating roller 2 to the sheet P, a developing agent image T on the sheet P is melted to allow the melted developing agent image T to be fixed to the sheet P.

Around the heating roller 2, a claw 9 for separating the sheet P from the heating roller 2, a cleaning member 10 for removing a residual developing agent, sheet dust, etc., on the heating roller 2, an oil coating roller 11 for coating an oil on the surface of the heating roller 2, induction heating coils 21, 22, and 23, temperature sensors 12 and 13 for detecting a temperature on a surface (surface member 7) of the heating roller 2 and a thermostat 14 configured to be opened, when a surface temperature of the heating roller 2 abnormally rises, are provided in that order.

The coil 21 is provided at a position corresponding to a middle portion of an axial direction of the heating roller 2. The coil 22 is provided at a position corresponding to one axial end portion of the heating roller 2. The coil 23 is provided at a position corresponding to the other axial end portion of the heating roller 2. These coils 21, 22 and 23 are provided on the coils 24, 25 and 26, respectively, and generate a high frequency magnetic field for induction heating. By applying the high frequency magnetic field to the heating roller 2, an eddy current is generated in the metal member 5 of the heating roller 2 and the metal member 5 is self-heat generated due to the Joule heat generated by the eddy current.

These coils 21, 22 and 23 are so formed that a copper wire is wound in a forward/backward repeated fashion along an axial direction of the heating roller 2. The copper wire is coated with a heat resistant enamel.

The coil 22 is outwardly extended by a distance A from the axial end edge of the heating roller 2. The coil 23 is outwardly extended by a distance A from the axial end edge of the heating roller 2.

The temperature sensor 12 is provided at a position corresponding to a middle area in the axial direction of the heating roller 2. The temperature sensor 13 is provided at a position corresponding to the other axial end portion of the heating roller 2. Further, the thermostat 14 is provided near the temperature sensor 12.

These temperature sensors 12 and 13 and thermostat 14 may be of either a contact type, for contacting the surface of the heating roller, or a non-contact type, set away from the heating roller 2.

A plate-like insulating member 27 is provided between the heating roller 2 and the coils 21, 22, and 23. The insulating member 27 is made of a heat resistant resin, such as heat resistant phenol, polyimide, or liquid crystal polymer.

Figure 4:
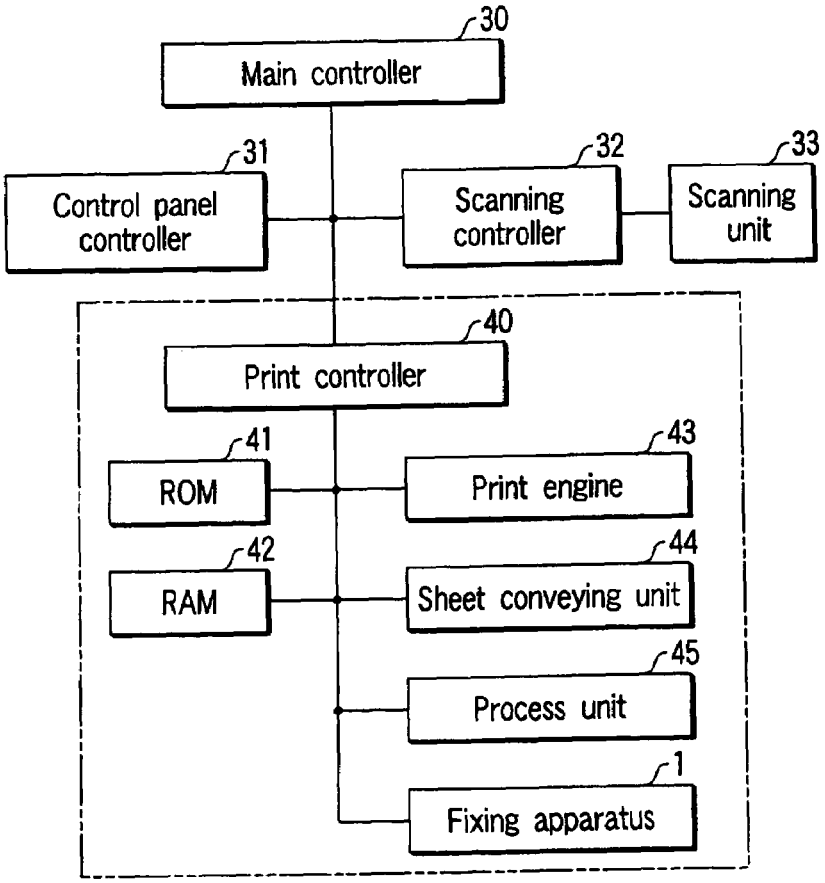
FIG. 4 is a block diagram showing a control circuit in an image forming apparatus of respective embodiments.

A control section of the image forming apparatus is shown in FIG. 4.

A control panel controller 31, scanning controller 32 and print controller 40 are connected to a main controller 30.

The main controller 30 controls the control panel controller 31, scanning controller 32 and print controller 40. The scanning controller 32 controls the scanning unit 33 for optically reading out a document image.

A ROM 41 for control program storage, a RAM 42 for data storage, a print engine 43, a sheet conveying unit 44, a process unit 45, and a fixing apparatus 1 are connected to the print controller 40. The print engine 43 generates laser light for forming an image which is canned by the scanning unit 33 onto a photosensitive drum of the process unit 45. The sheet conveying unit 44 comprises a sheet (P) conveying mechanism, a drive circuit, and so on. The process unit 45 allows an electrostatic latent image corresponding to a scanned image to be formed on the surface of the photosensitive drum by the laser light emitted from the print engine 43, the thus formed electrostatic latent image to be developed by a developing agent on the photosensitive drum and the thus formed developing agent image to be transferred to the sheet P.

Figure 5:
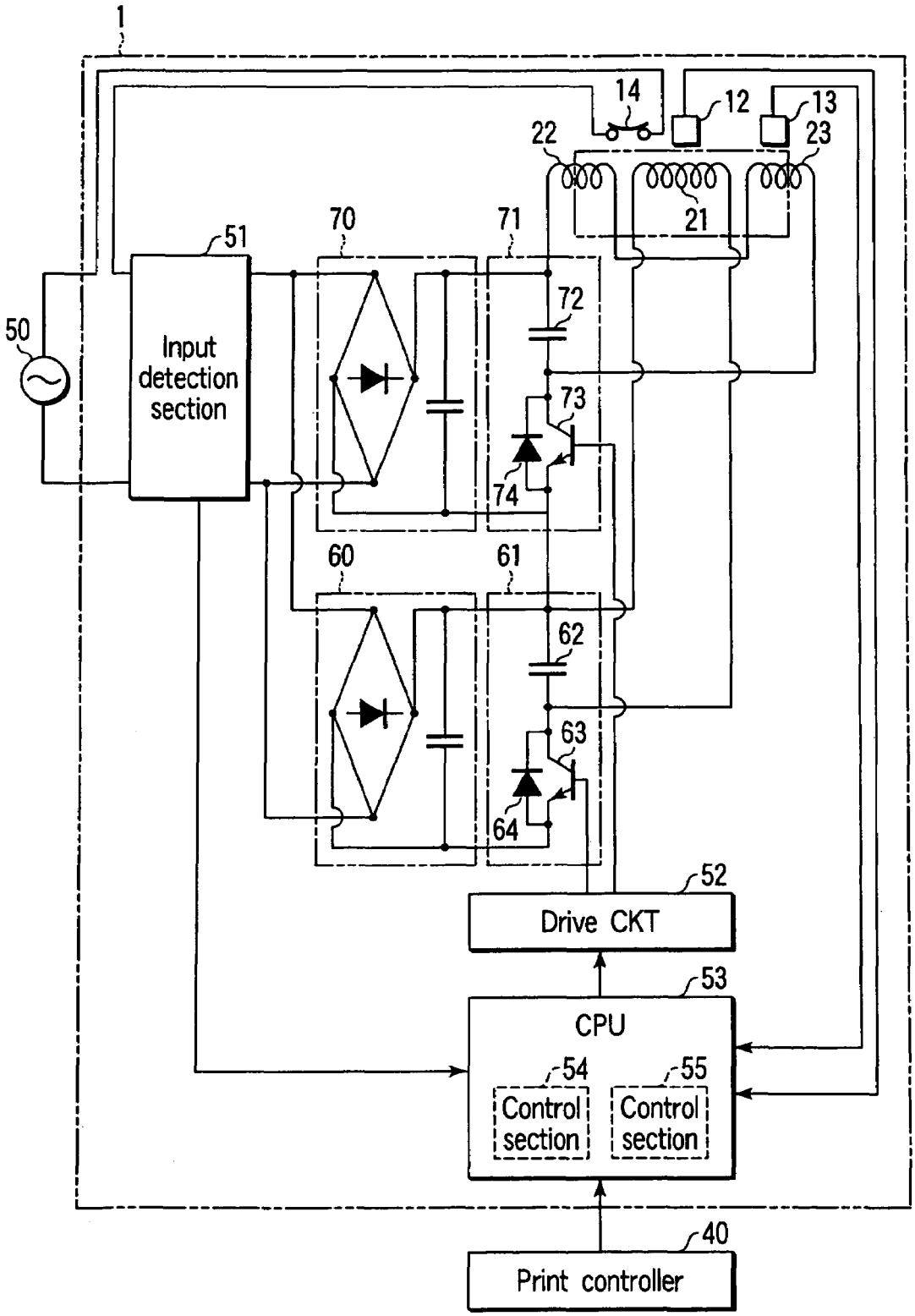
FIG. 5 is a block diagram showing an electric circuit for a fixing apparatus in the first to eighth embodiments.

FIG. 5 shows an electric circuit of the fixing apparatus 1.

Rectifier circuits 60 and 70 are connected to a commercial AC current source 50 through an input detection section 51 and thermostat 14. High frequency generation circuits (also called switching circuits or half-bridge type inverters) 61 and 71 are connected to the output terminals of the rectifier circuits 60 and 70.

The high frequency generation circuit 61 comprises a resonant capacitor 62 which, together with the coil 21, forms a resonance circuit, a switching element such as transistor 63 configured to excite the resonance circuit and a damper diode 64 connected in parallel with the transistor 63 and, by allowing the transistor 63 to be driven by the drive circuit 52 in an ON/OFF fashion, generates a high frequency current.

The high frequency generation circuit 71 comprises a resonant capacitor 72 which, together with the coils 22 and 23, forms a resonance circuit, a switching element such as a transistor 73 configured to excite the resonance circuit and a damper diode 74 connected in parallel with the transistor 73 and, by allowing the transistor 73 to be driven by the drive circuit 52 in an ON/OFF fashion, generates a high frequency current.

By supplying the high frequency currents from the high frequency generation circuits 61 and 71 to the coils 21, 22, and 23, high frequency magnetic fields are generated from the coils 21, 22, and 23. The metal member 5 of the heating roller 2 generates an eddy current under the high frequency magnetic field and is self-heated due to Joule heat generated by the eddy current.

In order to allow the energy of the high frequency magnetic field, which is generated from the coils 21, 22, and 23, to be efficiently absorbed in the metal member 5 of the heating roller 2, the metal member 5 may be made thicker or a higher frequency may be used as the frequency of the high frequency magnetic field generated from the coils 21, 22, and 23. For this reason, the frequency of the high frequency magnetic field generated from the coils 21, 22, and 23 is set to over 20 KHz, for example, 1 MHz to 4 MHz.

The input detection section 51 detects a voltage and current of the commercial AC current source 50 and, based on a result of detection, detects input power to the fixing apparatus 1. The result of the input detection section 51 is supplied to a CPU 53. The temperature sensors 12 and 13, print controller 40 and drive circuit 52 are connected to the CPU 53.

The CPU 53 has control sections 54 and 55. The control section 54 controls the output (the drive of the drive circuit 52) of the high frequency generation circuit 61 so as to set the detection temperature of the temperature sensor 12 to a predetermined value. The controller 55 controls the output (the drive of the drive circuit 52) of the high frequency generation circuit 71 so as to set the detection temperature of the temperature sensor 13 to a predetermined value.

As set out above, by adopting the heating roller 2 with the metal member 5 formed on the heat insulating member 4 and providing the induction heating coils 21, 22 and 23 outside the heating roller 2, it is possible to largely lower the heat capacity of the heating roller 2. Since the heat capacity of the heating roller 2 can be largely lowered, a rapid temperature rise of the heating roller 2 is obtained after a start operation.

The coils 21, 22, and 23 are provided outside the heating roller 2 and, therefore, a core metal 3 can be provided as a center member of the heating roller 2. By providing the core metal 3 it is possible to increase the strength of the heating roller 2.

It is to be noted that the core member 3 may be omitted if, in this case, an adequate strength of the heating roller 2 can be secured. In this case, the heating roller 2 becomes an air core structure. If an adequate strength of the heating roller 2 can be maintained, it is possible to use a resin member, such as plastic, in place of the core member 3.

The heat capacity of the heating roller 2 differs according to the axial position of the heating roller 2. That is, the heat capacity on both the axial end portions of the heating roller 2 is greater than that on the axial middle portion of the heating roller 2. Therefore, a temperature rise at each axial end portion of the heating roller 2 becomes slower than that at the axial middle portion of the heating roller 2.

In order to deal with such a different heat capacity problem, the coil 22 is outwardly extended by a distance A from the axial end edge of the heating roller 2 and the coil 23 is outwardly extended by a distance A from the axial end edge of the heating roller 2. By this structure, a high frequency magnetic field from the coils 22 and 23 can be efficiently applied to both the axial end portions of the heating roller 2. By doing so, a heating level is increased at both the axial end portions of the heating roller 2, so that the temperature distribution becomes uniform over the axial direction of the heating roller 2.

In the case where the sheet (P) passing area is displaced toward the axial end of the heating roller 2, the above-mentioned outwardly extending (distance A) coil structure may be adopted only on one side of either of the coils 22 and 23. That is, in the case where a passing area of the sheet P is displaced toward one axial end of the heating roller 2, at least the coil 22 is outwardly extended from one axial end edge of the heating roller 2. In the case where a passing area of the sheet P is displaced toward the other axial end of the heating roller 2, on the other hand, at least the coil 23 is outwardly extended from the other axial end edge of the heating roller 2.

Further, since the insulating member 27 is provided between the heating roller 2 and the coils 21, 22 and 23, there is no possibility that the coils 21, 22 and 23 will contact the surface of the heating roller 2. As a result, no damage is caused to the surface of the heating roller 2 and there is no short-circuiting between the metal member 5 of the heating roller 2 and the coils 21, 22, and 23.

Since the temperature sensors 12 and 13 are provided more on a downstream side than at the positions of the coils 21, 22, and 23 in the rotation direction of the heating roller 2, it is possible to accurately detect the temperature of the heating roller 2 under the induction heating.

The thermostat 14 is provided more on a downstream side than at the positions of the coils 21, 22, and 23 in the rotation direction of the heating roller 2 and it is possible to accurately detect any abnormal temperature rise of the heating roller 2 under the induction heating. In this case, the thermostat 14 is opened, thereby interrupting a conduction current from the commercial AC current source 50 to the fixing apparatus 1.

It may be considered that, in place of the heating roller 2, use is made of a heating belt comprised of a metal member stacked on an upper surface of an elastic belt. This heating belt, like the heating roller 2, has a smaller heat capacity and is entrained around a pair of rollers. In this connection it is to be noted that the heating belt is likely to be displaced in a direction perpendicular to the rotation direction. If therefore, the heating belt is used, it is necessary to adjust the position of the heating belt in the direction perpendicular to the rotation direction. It is also necessary to adjust the tension of the heating belt since the heating belt is entrained between the pair of rollers.

Such positional adjustment and tension adjustment is unnecessary by adopting the heating roller.

[2] An explanation will be made below about a second embodiment of the present invention.

Figure 6:
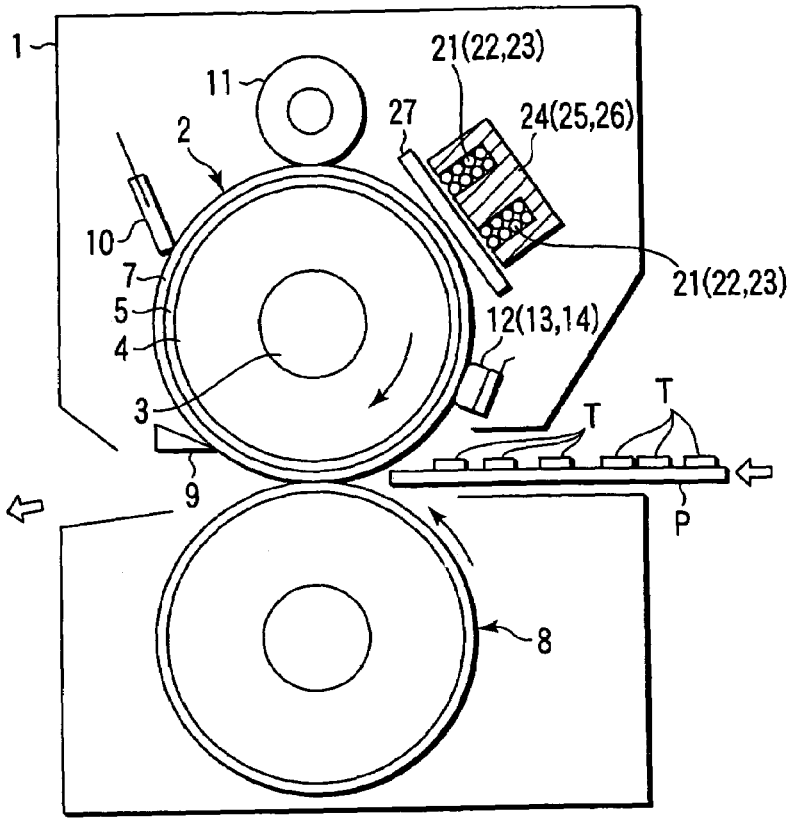
FIG. 6 is a view showing a structure of the fixing apparatus of the second embodiment of the present invention.

As shown in FIG. 6, a heating roller 2 is so configured as to form a heat insulating member 4 of, for example, 5 mm thick, metal member 5 of, for example, 40 μm thick and surface member 7 of, for example, 20 μm, in that order, on a core metal 3. That is, the elastic member 6 of the first embodiment is not used in the second embodiment and the remaining structure, function and effects of the second embodiment are the same as those of the first embodiment.

[3] A third embodiment of the present invention will be explained below.

Figure 7:
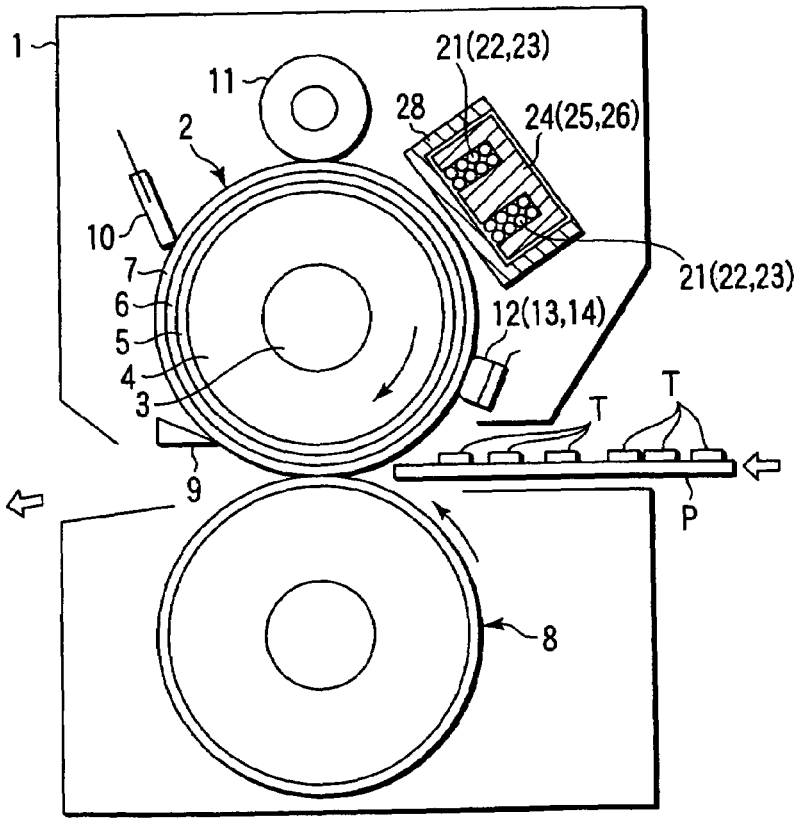
FIG. 7 is a view showing a structure of the third embodiment of the present invention.

As shown in FIG. 7, coils 21, 22, and 23 and cores 24, 25, and 26 are held in a casing made of an insulating material. The casing 28 is such that its surface at least opposite a heating roller 2 is formed of a heat resistant resin, such as a heat resistant phenol, polyimide, or liquid crystal polymer.

The third embodiment adopts the casing 28 and does not use the insulating member 27 of the first embodiment.

In this way, the coils 21, 22, and 23 and cores 24, 25 and 26 are held as one unit in the casing 28 and, by doing so, it is easier to exchange the coils 21, 22, and 23 and cores 24, 25, and 26. The remaining structure, function and effects of this third embodiment are the same as those of the first embodiment.

[4] A fourth embodiment of the present invention will be explained below.

Figure 8:
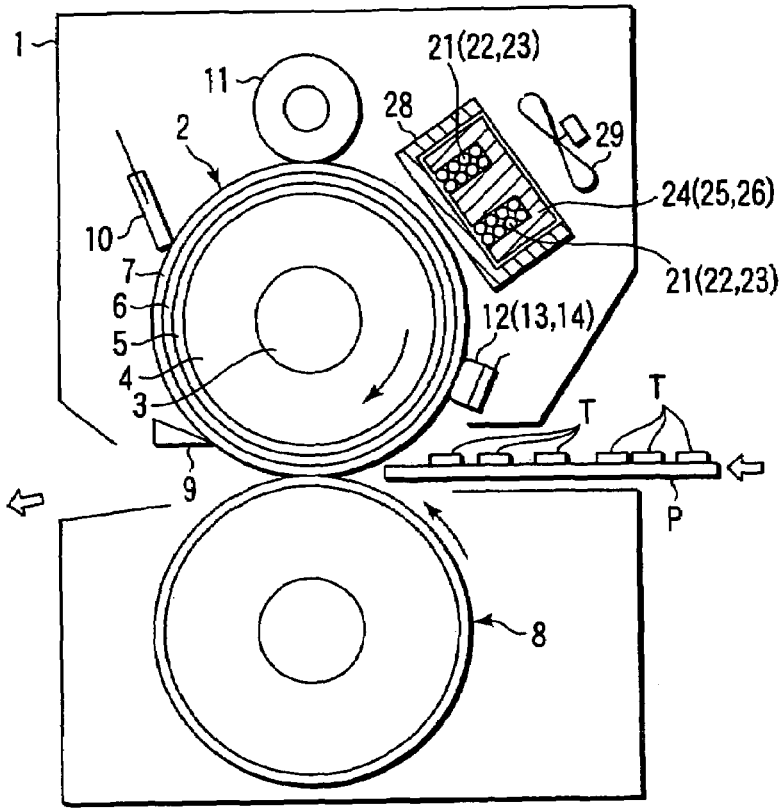
FIG. 8 is a view showing a structure of the fixing structure of the fourth embodiment of the present invention.

As shown in FIG. 8, a cooling fan 29 is provided near a casing 28 to allow cooling air to be supplied through an opening of the casing 28 onto coils 21, 22, and 23. The air of the cooling fan is supplied into the casing 28 alone and not onto a heating roller 2.

The other structure, function and effects of the fourth embodiment are the same as those of the third embodiment.

[5] A fifth embodiment of the present invention will be explained below.

Figure 9:
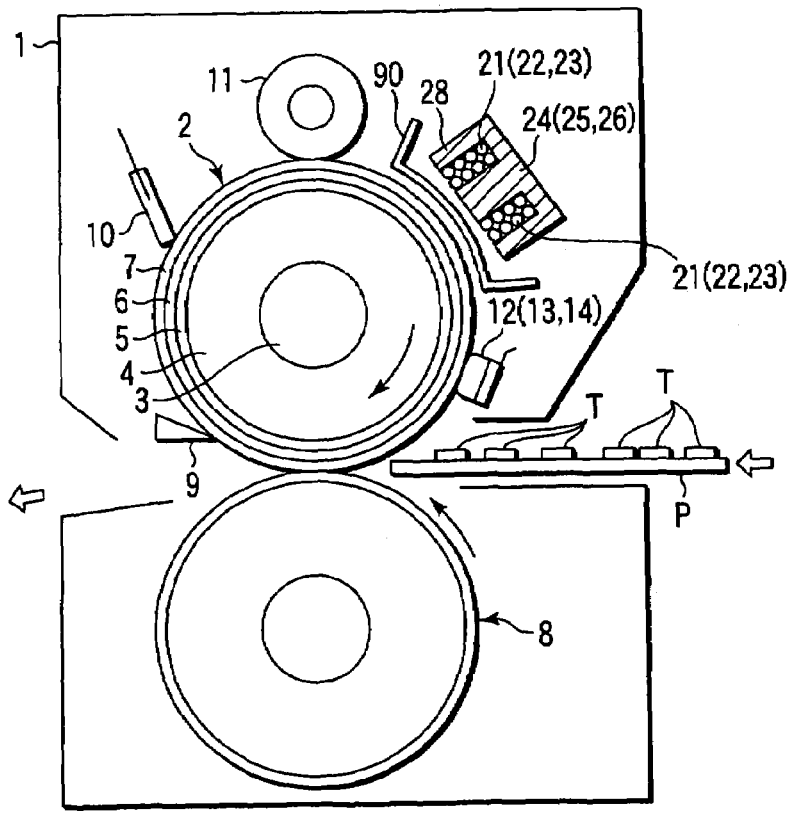
FIG. 9 is a view showing a structure of the fifth embodiment of the present invention.

As shown in FIG. 9, coils 21, 22, and 23 and cores 24, 25 and 26 are covered with an insulating member 90. The insulating member 90 is formed of a heat resistant resin, such as heat resistant phenol, polyimide or liquid crystal polymer.

The fifth embodiment adopts the insulating member 90 and does not use the insulating member 27 of the first embodiment. The other structure, function and effects are the same as those of the first embodiment.

[6] A sixth embodiment of the present invention will be explained below.

Figure 10:
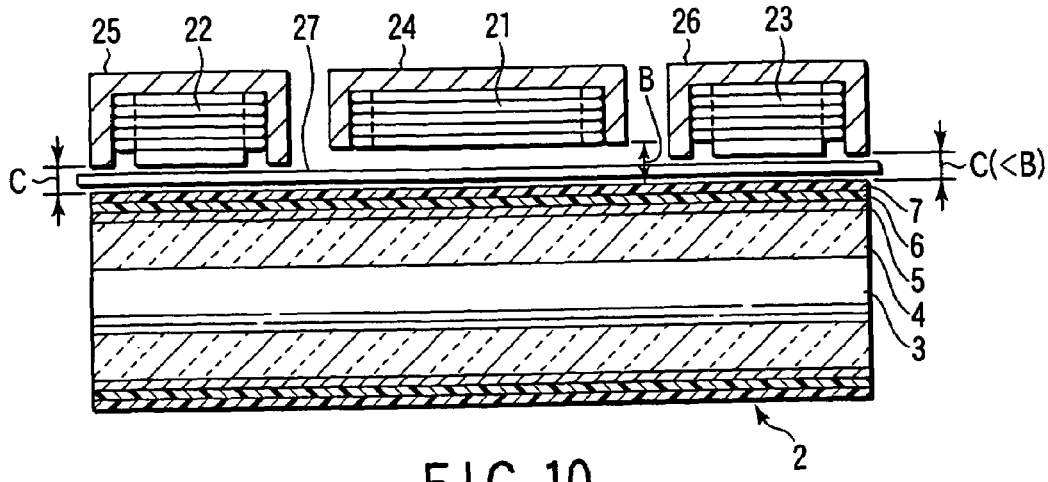
FIG. 10 is a view showing a structure of a heating roller, respective coils and respective cores in the sixth embodiment of the present invention.

As set out above, a heat capacity of both axial end portions of a heating roller 2 is greater than that of an axial middle portion of the heating roller 2. In order to deal with such a problem, as shown in FIG. 10, cores 25 and 26, holding coils 22 and 23 in place are arranged near the surface of the heating roller 2. That is, a distance B is set between a coil 21 and the surface of the heating roller 2 and a distance C (<B) is set between coils 22 and 23 and the surface of the heating roller 2.

By this structure, a high frequency magnetic field generated from the coils 22 and 23 can be applied efficiently to both axial ends of the heating roller 2. A heating level at both axial end portions of the heating roller is increased and a temperature distribution is made uniform over the axial direction of the heating roller 2.

If a sheet passing area is displaced toward one of the axial ends of the heating roller 2, either one of the cores 25 and 26 may be set close to the surface of the heat roller 2. That is, if the sheet passing area is displaced toward one axial end of the heating roller 2, at least a core 24 is set close to the surface of the heating roller 2. If, on the other hand, the sheet passing area is displaced toward the other axial end side of the heating roller 2, at least the core 25 is set close to the surface of the heating roller.

The other structure, function and effects are the same as those of the first embodiment.

[7] An explanation will be made below about a seventh embodiment of the present invention.

Figure 11:
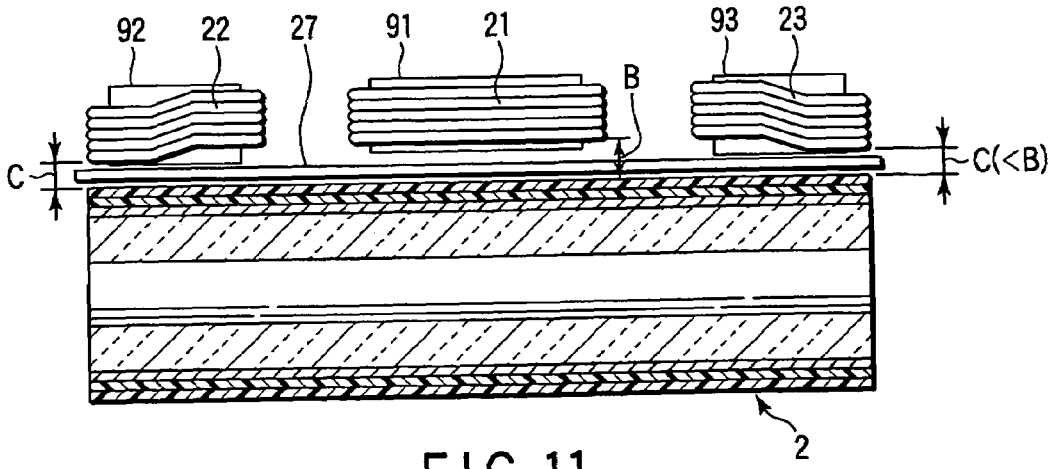
FIG. 11 is a view showing a structure of a heating roller, respective coils and respective cores in the seventh embodiment of the present invention.

As shown in FIG. 11, coils 21, 22 and 23 are retained on retaining members 91, 92 and 93. A portion of the coil 22 (an area corresponding to one axial end edge portion of a heating roller 2) is set near the surface of the heating roller 2. A portion of the coil 23 (an area corresponding to the other axial end edge portion of the heating roller 2) is set near the surface of the heating roller 2. That is, a distance B is set between the coil 21 and the surface of the heating roller 2 and a distance C (<B) is set between these portions of the coils 22 and 23 and the surface of the heating roller 2.

By this structure, a high frequency magnetic field generated from the coils 22 and 23 can be efficiently applied to both the axial end portions of the heating roller 2. As a result, a heating level is increased relative to both the axial end portions of the heating roller 2 to allow a temperature distribution to be set uniform relative to the axial direction of the heating roller 2.

If a passing area of a sheet P is displaced toward one of the axial ends of the heating roller 2, only one of coils 22 and 23 is set near the surface of the heating roller 2. That is, in the case where a passing area of the sheet P is displaced toward one axial end of the heating roller 2, at least a portion of the coil 22 is set near the surface of the heating roller 2. In the case where, on the other hand, the passing area of the sheet P is displaced toward the other end of the heating roller 2, at least a portion of the core 25 is set near the surface of the heating roller 2.

The other structure, function and effects of this embodiment are the same as in the first embodiment.

[8] An eighth embodiment of the present invention will be described below.

Figure 12:
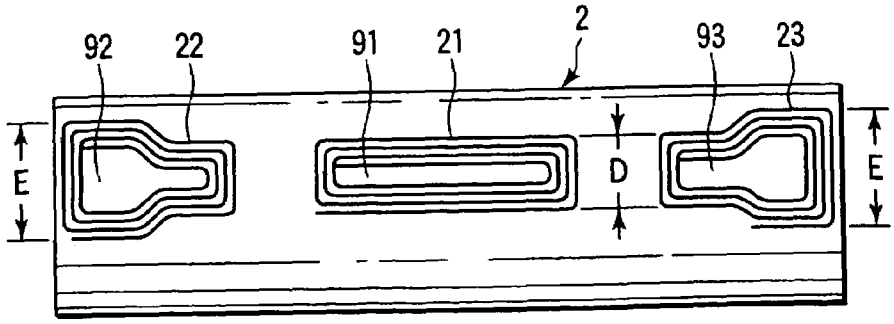
FIG. 12 is a view showing a structure of a heating roller, respective coils and respective cores of the eighth embodiment of the present invention.

As shown in FIG. 12, coils 21, 22 and 23 are mounted on retaining members 91, 92 and 93. The diameter of a portion of the coil 22 (an area corresponding to one axial end edge portion of a heating roller 2) is enlarged in a direction substantially orthogonal to the axial direction of the heating roller 2. A diameter of a portion of the coil 23 (an area corresponding to the other axial end edge portion of the heating roller 2) is enlarged in a direction substantially orthogonal to the axial direction of the heating roller 2. That is, the diameter of the coil 21 is set to D and the diameters of the coils 22 and 23 are set to E (<D).

By this structure, a high frequency magnetic field generated from the coils 22 and 23 can be efficiently applied to both the axial ends of the heating roller. As a result, a heating level is increased relative to both the axial end portions of the heating roller 2 to allow a temperature distribution to be set uniform relative to the axial direction of the heating roller 2.

In the case where a passing area of a sheet P is displaced toward one of the axial ends of the heating roller 2, a diameter enlarging structure may be adopted to either one of the coils 22 and 23. That is, in the case where the sheet passing area is displaced toward one axial end of the heating roller 2, the diameter of at least a portion of the coil 22 is enlarged in a direction substantially orthogonal to the axial direction of the heating roller 2. In the case where the sheet passing area is displaced toward the other axial end of the heating roller 2, the diameter of at least a portion of the coil 25 is enlarged in a direction substantially orthogonal to the axial direction of the heating roller 2.

The other structure, function and effects of this embodiment are the same as in the first embodiment.

[9] An explanation will be made below about a ninth embodiment of the present invention.

Figure 13:
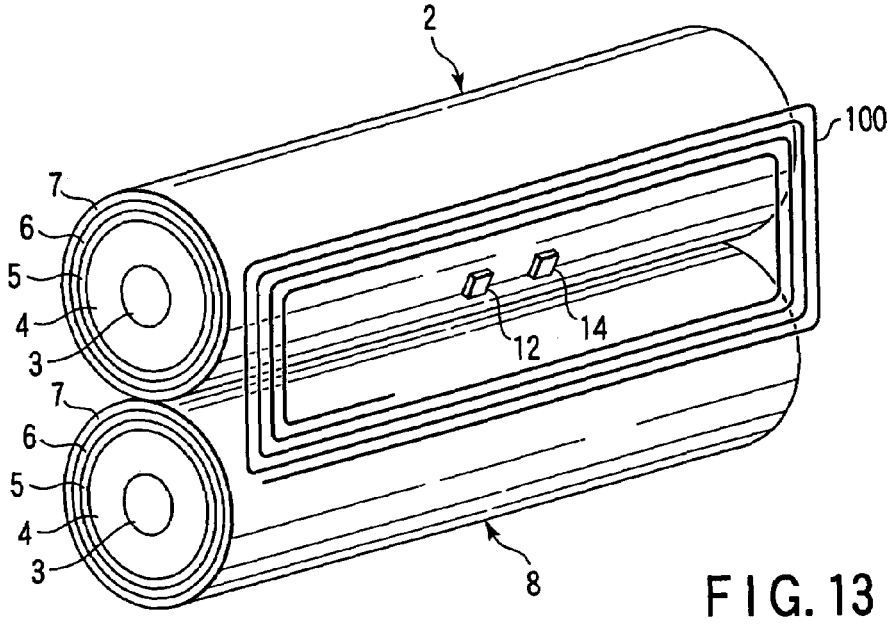
FIG. 13 is a view showing a structure of a heating roller, pressing roller and coils in a ninth embodiment of the present invention.

As shown in FIG. 13, a pressing roller 8, like a heating roller 2, is so configured that a heat insulating member 4, metal member 5, elastic member 6 and surface member 7 are formed, in that order, on a core metal 3.

One coil 100 for induction heating is provided at a position corresponding to both the pressing roller 8 and heating roller 2. Though not shown in the Figure, the coil 100 is mounted on a core and generates a high frequency magnetic field for induction heating. The metal member 5 of the heating roller 2 and metal member 5 of the pressing roller 8 are heat generated by applying the high frequency magnetic field to the heating roller 2 and pressing roller 8.

Further, the coil 100 is so configured that a copper wire is wound, in a forward/backward repetition fashion, along an axial direction of the heating roller 2.

Figure 14:
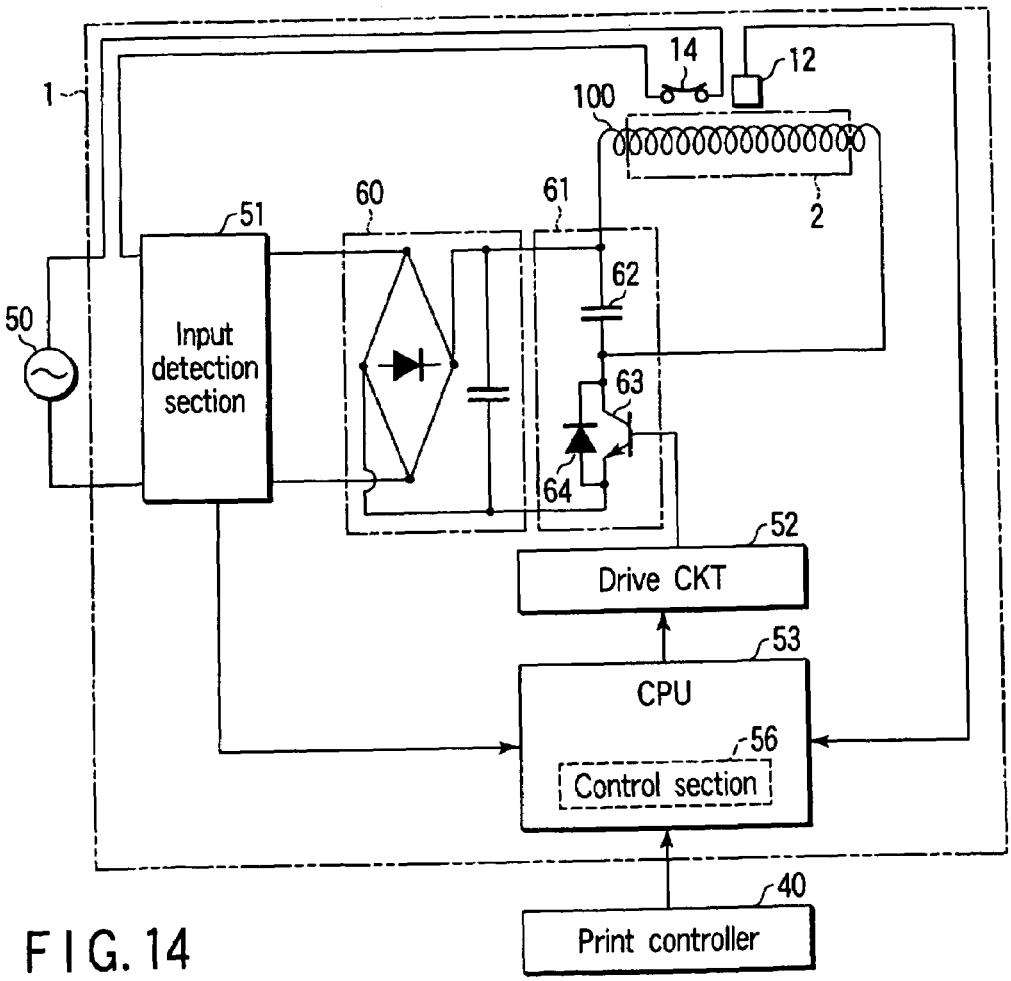
FIG. 14 is a block diagram of an electric circuit of a fixing apparatus of the ninth embodiment of the present invention.

FIG. 14 shows an electric circuit for the fixing device 1.

A rectifier circuit 60 is connected to a commercial AC current source 50 through an input detection section 51 and thermostat 14. A high frequency generation circuit 61 is connected to an output terminal of the rectifier circuit 60.

The high frequency generation circuit 61 comprises a resonant capacitor 62 constituting, together with the coil 100, a resonance capacitance, a switching element, such as a transistor 63, configured to excite the resonance circuit, and a damper diode 64 connected in parallel with the transistor 63 and generates a high frequency current by allowing the transistor to be driven by a drive circuit 52 in an ON/OFF fashion. The high frequency current is supplied to the coil 100.

A temperature sensor 12, print controller 40 and drive circuit 52 are connected to a CPU 53. The CPU 53 has a control section 56. The control section 56 controls an output (a drive of the drive circuit 52) of the high frequency generation circuit 61 to allow the detection temperature of the temperature sensor 12 to be set to a predetermined value.

By thus induction-heating the heating roller 2 and pressing roller 8 it is possible to secure a necessary and sufficient heating level for a sheet P even if the heat capacity of the heating roller 2 is smaller. That is, a heat energy rather less likely to be produced due to less heat capacity of the heating roller 2 is compensated by the heat generation of the pressing roller 8.

The other structure, function and effects are the same as in the first embodiment.

[10] An explanation will be made below about a tenth embodiment of the present invention.

Figure 15:
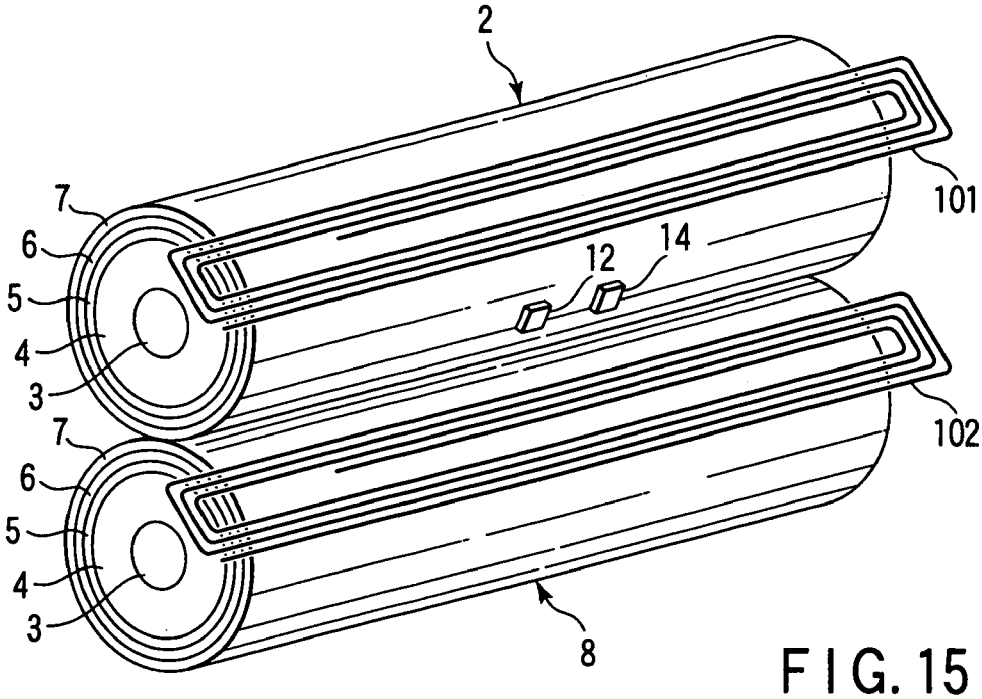
FIG. 15 is a view showing a heating roller, pressing roller and respective coils in a tenth embodiment of the present invention.

As shown in FIG. 15, a pressing roller 8, like a heating roller 2, is so configured that a heat insulating member 4, metal member 5, elastic member 6, and surface member 7 are formed, in that order, on a core metal 3.

One coil 101 for the heating roller for induction heating is provided at a position corresponding to the heating roller 2. The coil 101 is mounted on the core, though not shown, and generates a high frequency magnetic field for induction heating. The metal member 5 of the heating roller 2 is heat-generated by applying the high frequency magnetic field to the heating roller 2.

One coil 102 for the pressing roller 8 for induction heating is provided at a position corresponding to the pressing roller 8. The coil 102 is mounted on the core, though not shown, and generates a high frequency magnetic field for induction heating. The metal member 5 of the pressing roller 8 is heat-generated by applying the high frequency magnetic field to the pressing roller 8.

Figure 16:
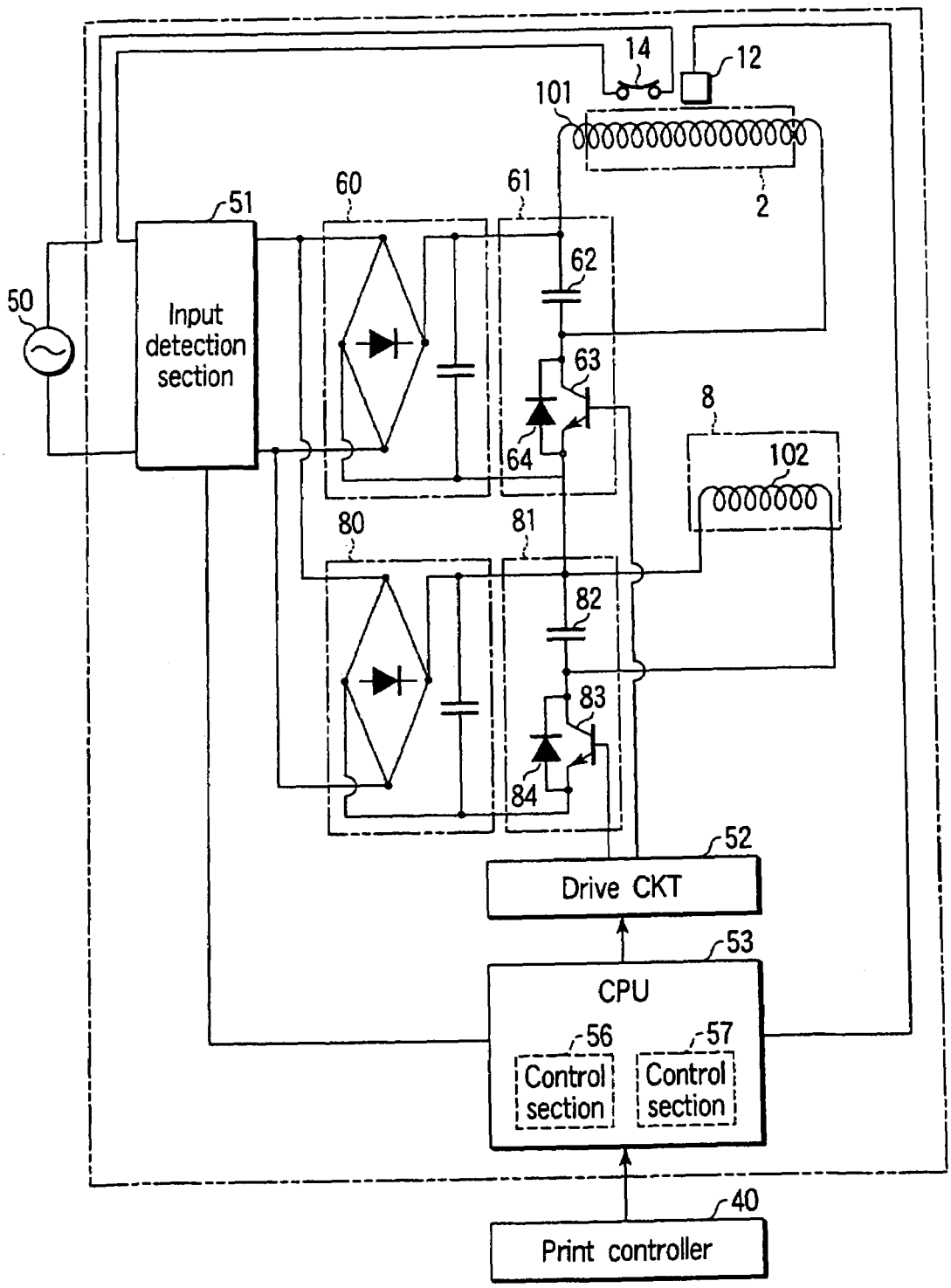
FIG. 16 is a block diagram showing an electric circuit of a fixing apparatus in the tenth embodiment.

FIG. 16 shows an electric circuit of a fixing apparatus 1.

Rectifier circuits 60 and 80 are connected to a commercial AC current source 50 through an input detection section 51 and thermostat 14. High frequency generation circuits 61 and 81 are connected to the output terminals of the rectifier circuits 60 and 80, respectively.

The high frequency generation circuit 61 comprises a resonant capacitor 62 constituting, together with the coil 101, a resonance circuit, a switching element, such as a transistor 63, configured to excite the resonance circuit, and a damper diode 64 connected in parallel with the transistor 63 and generates a high frequency current by allowing the transistor 63 to be driven by a drive circuit 52 in an ON/OFF fashion. The high frequency current is supplied to the coil 101.

The high frequency generation circuit 81 comprises a resonant capacitor 82 constituting, together with the coil 102, a resonance circuit, a switching element such as a transistor 83 configured to excite the resonance circuit, and a damper diode 84 connected in parallel with the transistor 83 and, by allowing the transistor 83 to be driven by the drive circuit 52 in an ON/OFF fashion, generates a high frequency current. The high frequency current is supplied to the coil 102.

A temperature sensor 12, print controller 40 and drive circuit 52 are connected to a CPU 53.

The CPU 53 has control sections 56 and 57. The control section 56 controls an output (drive of the drive circuit) of the high frequency generation circuit 61 so as to set a detection temperature of the temperature sensor 12 to a predetermined value. In the case where the detection temperature of the temperature sensor 12 is lowered to below that set value, the control section 57 operates the high frequency generation circuit 81.

If, in this way, the heat capacity of the heating roller 2 is smaller by induction-heating both the heating roller 2 and pressing roller 8, it is possible to secure a necessary and sufficient heating level for a sheet P.

It is to be noted that the electric circuit is not restricted to the one alone as shown in FIG. 16 and it is possible to adopt a circuit by which either one of the coils 101 and 102 is selectively operated by a mutually different resonance frequency.

The other structure, function and effects are the same as in the first embodiment.

[11] An explanation will be made below about an eleventh embodiment of the present invention.

Figure 17:
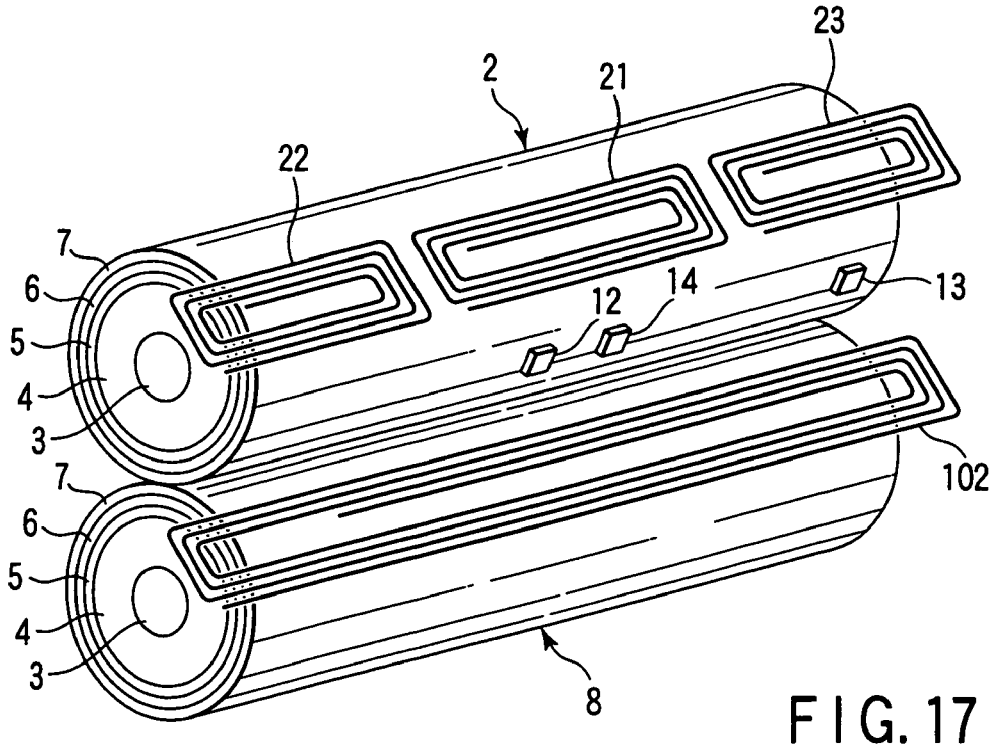
FIG. 17 is a view showing a structure showing a heating roller, pressing roller and respective coils in the eleventh embodiment of the present invention.

As shown in FIG. 17, a pressing roller 8, like a heating roller 2, is so configured that a heat insulating member 4, metal member 5, elastic member 6 and heating member 7 are formed, in that order, on a core member 3.

As in the first embodiment, three coils 21, 22 and 23 for induction heating are provided at those positions corresponding to the heating roller 2. The coils 21, 22 and 23 are mounted on the cores 24, 25 and 26, not shown in FIG. 17, as in the first embodiment of the present invention.

As in the tenth embodiment, one coil 102 for induction heating is provided, as in the tenth embodiment, at a position corresponding to the pressing roller 8.

Figure 18:
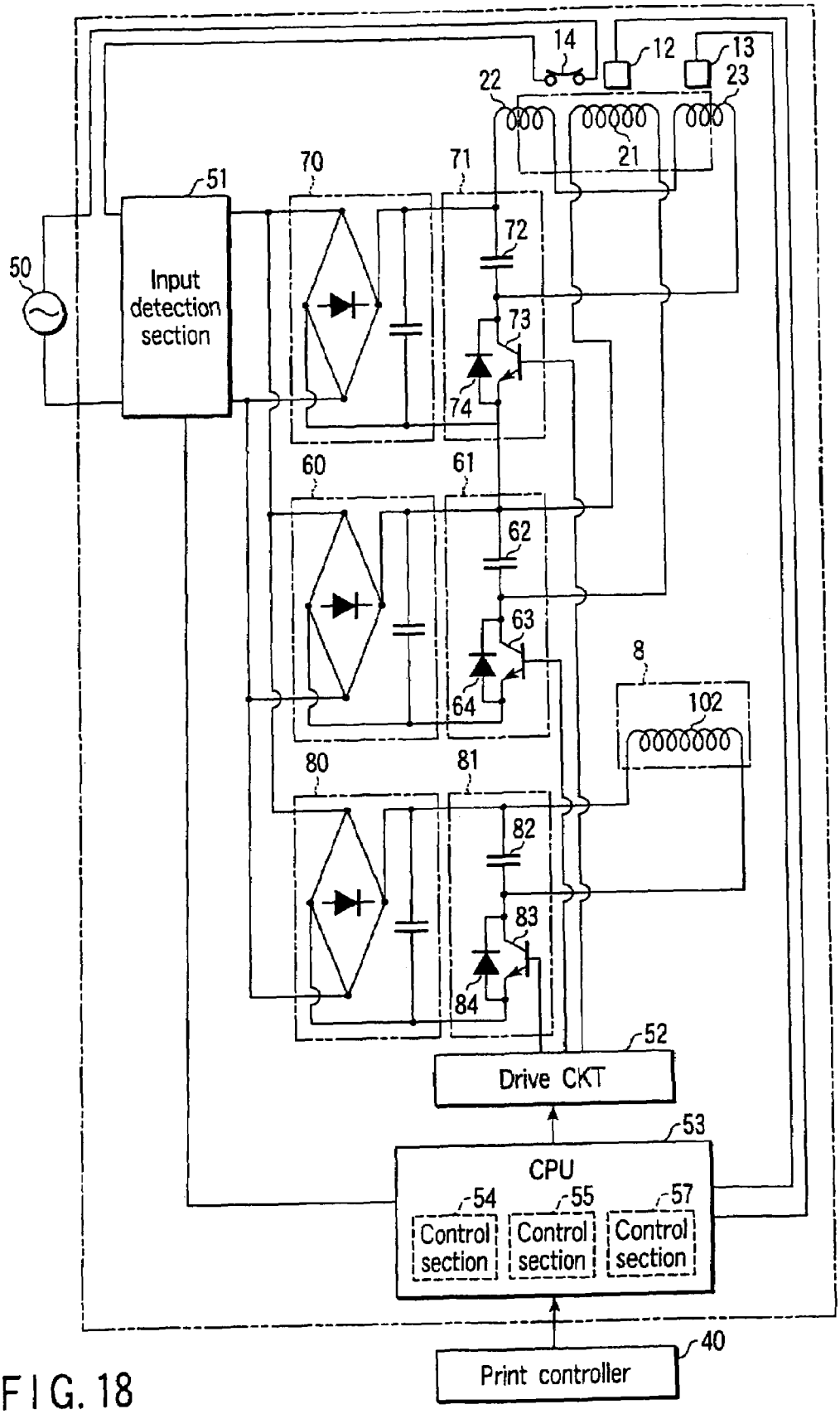
FIG. 18 is a block diagram of an electric circuit of a fixing apparatus shown in the eleventh embodiment of the present invention.

FIG. 18 shows an electric circuit of a fixing apparatus 1. This electric circuit corresponds to a combination of the electric circuit shown in the first embodiment and electric circuit shown in the tenth embodiment.

By thus induction-heating both the heating roller 2 and pressing roller 8 it is possible to secure a necessary and sufficient heating level for a sheet P even if, for example, the heat capacity of the heating roller 2 is smaller.

The other structure, function and effects are the same as in the first embodiment.

[12] An explanation will be made below about a twelfth embodiment of the present invention.

Figure 19:
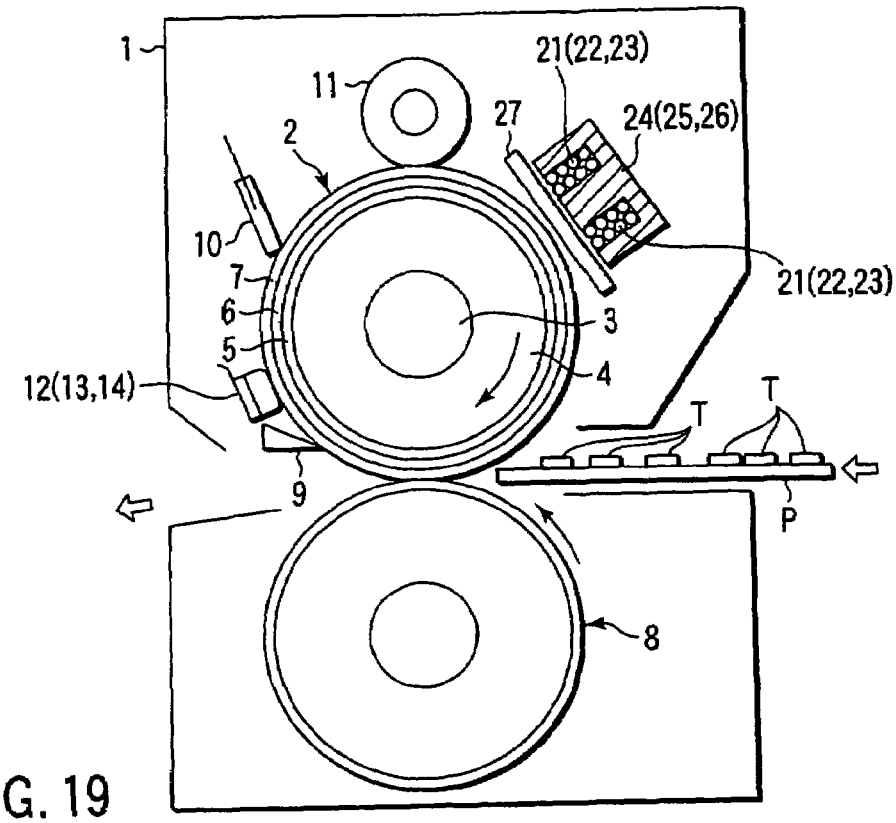
FIG. 19 is a view showing a structure of a fixing apparatus of a twelfth embodiment.

As shown in FIG. 19, temperature sensors 12 and 13 and thermostat 14 are provided more on a downstream side in a rotation direction of a heating roller 2 than a contacting site (nip) between the heating roller 2 and a pressing roller 8.

The temperature sensors 12 and 13 detect, of a surface temperature of the heating roller 2, a surface temperature just after a nip between the heating roller 2 and the pressing roller 8. The thermostat 14 is set in an opened state in the case where, of the surface temperature of the heating temperature, the temperature just after the nip between the heating roller 2 and the pressing roller 8 is raised to an abnormal level.

The other structure, function and effects are the same as in the first embodiment of the present invention.

[13] An explanation will be made below about a thirteenth embodiment of the present invention.

Figure 20:
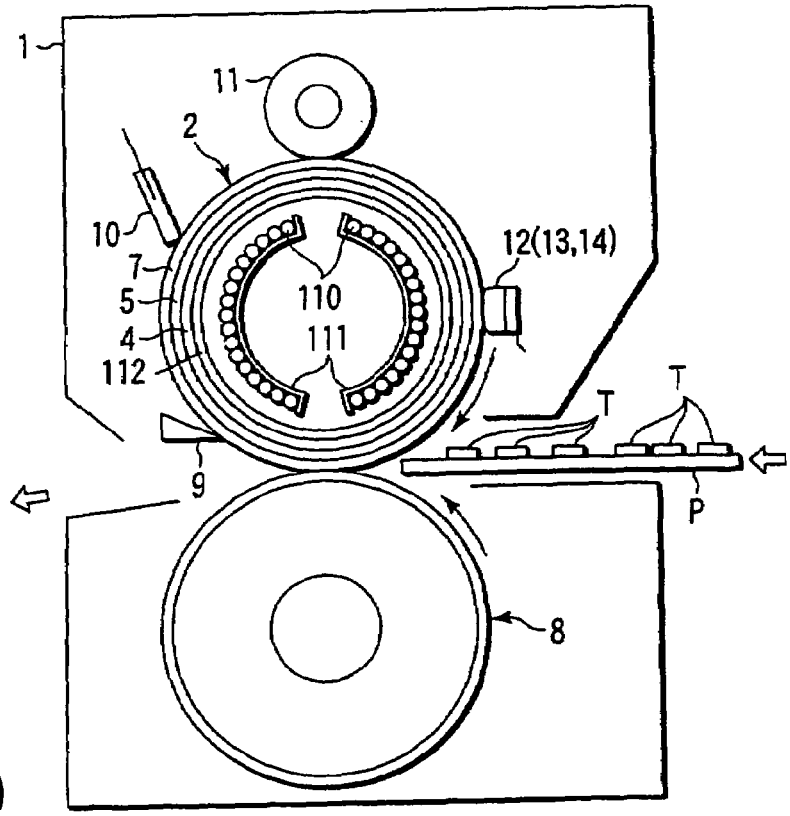
FIG. 20 is a view showing a structure of a fixing apparatus of a thirteenth embodiment of the present invention.

As shown in FIG. 20, a heating roller 2 is such that a nonmetal member 112 of, for example 2 mm thick, heat insulating member 4 of, for example, 0.5 mm thick, metal member 5 of, for example, 50 μm and surface member 7 of, for example, 20 μm are formed are formed in that order as a drum-like configuration. A coil 110 for induction heating is held within an inner space of the heating roller 2.

The coil 110 is mounted on a retaining member 111 and generates a high frequency magnetic field for induction heating, and the metal member 5 is heat-generated by applying the high frequency magnetic field to the metal member 5.

It is to be noted that an elastic member 6 may be provided between the metal member 5 and the surface member 7 as in the first embodiment of the present invention.

The other structure, function and effects are the same as in the tenth embodiment of the present invention.

Additional advantages and modifications will readily occur to those skilled in the art. Therefore, the invention in its broader aspects is not limited to the specific details and representative embodiments shown and described herein. Accordingly various modifications may be made without departing from the spirit or scope of the general inventive concept as defined by the appended claims and their equivalents.

What is claimed is:

1. A fixing apparatus comprising:

a heating roller which has a heat insulating member and a conductive member formed on the insulating member;

a first coil provided outside the heating roller to generate a high frequency magnetic field for induction-heating the heating roller; and a second coil provided outside the heating roller to generate a high frequency magnetic field for induction-heating the heating roller;

the second coil including a portion which is spaced from the heating roller by a distance substantially equal to a distance between the first coil and the heating roller, and a portion spaced from the heating roller by a distance shorter than the distance between the first coil and the heating roller.

2. The apparatus according to claim 1, wherein the heating roller is so configured that the heat insulating member, the conductive member and a surface member are formed in that order on a core metal.

3. The apparatus according to claim 1, wherein the heating roller is so configured that the heat insulating member, the conductive member, an elastic member and a surface member are formed in that order on a core metal.

4. The apparatus according to claim 1, further comprising an insulating member formed between the heating roller and the first and second coils.

5. The apparatus according to claim 1, further comprising a casing which holds the first and second coils.

6. The apparatus according to claim 1, further comprising a fan configured to supply cooling air to the first and second coils.

7. The apparatus according to claim 1, wherein the first and second coil are so formed that a copper wire is wound in a forward/backward repetition fashion along an axial direction of the heating roller.

8. The apparatus according to claim 1, wherein the first and second coils are aligned in the axial direction of the heating roller.

9. The apparatus according to claim 1, wherein the second coil is outwardly extended from the corresponding axial end of the heating roller.

10. The apparatus according to claim 1, wherein the first coil is provided at a position corresponding to a middle area in an axial direction of the heating roller, and the second coil is provided at positions corresponding to both end portions as viewed in the axial direction of the heating roller.

11. A fixing apparatus comprising:

a heating roller configured to have a heat insulating member and a metal member formed on the insulating member;

a first coil provided outside the heating roller to generate a high frequency magnetic field for induction-heating the heating roller; and a second coil provided outside the heating roller to generate a high frequency magnetic field for induction-heating the heating roller, the second coil is such that a diameter of a portion corresponding to an axial end edge portion of the heating roller is extended in a direction orthogonal to an axial direction of the heating roller.

12. The apparatus according to claim 11, wherein the second coil is such that a diameter of a portion corresponding to the axial end edge portion of the heating roller is more extended in a direction orthogonal to the axial direction of the heating roller than a remaining portion of the second coil.

13. The apparatus according to claim 11, wherein the first coil is provided at a position corresponding to a middle area in the axial direction of the heating roller, and the second coil is provided at positions corresponding to both end portions as viewed in the axial direction of the heating roller.

14. The apparatus according to claim 13, wherein at least one of the positions of the second coil corresponding to the both end portions in the axial direction of the heating roller is such that a diameter of a portion corresponding to the axial end edge portion of the heating roller is extended in a direction orthogonal to the axial direction of the heating roller.

15. The apparatus according to claim 11, wherein the first and second coils are so formed that a copper wire is wound in a forward/backward repetition fashion along the axial direction of the heating roller.

16. The apparatus according to claim 11, wherein the first and second coils are aligned in the axial direction of the heating roller.

* * * * *